US006702009B1

(12) United States Patent
Drury et al.

(10) Patent No.: US 6,702,009 B1
(45) Date of Patent: Mar. 9, 2004

(54) SELECT-FIRE PRESSURE RELIEF SUBASSEMBLY FOR A CHEMICAL CUTTER

(75) Inventors: Derrek Drury, Fort Worth, TX (US); Robert C. Andres, Fort Worth, TX (US)

(73) Assignee: Diamondback Industries, Inc., Crowley, TX (US)

( * ) Notice: Subject to any disclaimer, the term of this patent is extended or adjusted under 35 U.S.C. 154(b) by 16 days.

(21) Appl. No.: 10/209,064

(22) Filed: Jul. 30, 2002

(51) Int. Cl.[7] ..... E21B 29/02

(52) U.S. Cl. ..... 166/55; 166/55.8; 166/212

(58) Field of Search ..... 166/55, 55.8, 63, 166/72, 169, 212, 299, 319, 373

(56) References Cited

U.S. PATENT DOCUMENTS

| | | | | |
|---|---|---|---|---|
| 4,125,161 A | | 11/1978 | Chammas | |
| 4,158,389 A | | 6/1979 | Chammas et al. | |
| 4,180,131 A | | 12/1979 | Chammas | |
| 4,234,768 A | | 11/1980 | Boop | |
| 4,250,960 A | | 2/1981 | Chammas | |
| 4,428,430 A | | 1/1984 | Terrell et al. | |
| 4,494,601 A | * | 1/1985 | Pratt et al. | 166/55 |
| 4,620,591 A | | 11/1986 | Terrell et al. | |
| 4,819,728 A | | 4/1989 | Lafitte | |
| 4,949,789 A | | 8/1990 | Lafitte | |
| 5,287,920 A | * | 2/1994 | Terrell | 166/55 |
| 5,322,118 A | | 6/1994 | Terrell | |
| 5,509,480 A | * | 4/1996 | Terrell et al. | 166/297 |
| 5,531,164 A | | 7/1996 | Mosley | |

* cited by examiner

*Primary Examiner*—Roger Schoeppel
(74) *Attorney, Agent, or Firm*—Mark W. Handley; Chauza & Handley, L.L.P.

(57) ABSTRACT

A downhole chemical cutter (12) has first and second passages (124, 126) which extend parallel, in fluid communication with an interior passage (32). A first ignitor (210) in the first passage (124) ignites a propellant (34) in the interior passage (32) to dispense a cutting chemical (46). The second passage (126) extends from the interior passage (32) to an exterior of the chemical cutter (12), and is sealed by members (176, 156). After the first ignitor (210) is fired, the second ignitor (218) is fired to push the members (176, 156) from sealing the second ignitor passage (126), such that the interior passage (32) is in fluid communication with the exterior of the chemical cutter (12). A control circuit (252) has two diodes (106, 110) connected in parallel and configured for passing current of opposite polarity to respective ones of the first and second ignitors (210, 218).

20 Claims, 5 Drawing Sheets

SELECT-FIRE PRESSURE RELIEF SUBASSEMBLY FOR A CHEMICAL CUTTER

TECHNICAL FIELD OF THE INVENTION

The present invention relates in general to a pressure relief subassembly for a chemical cutting tool used in oil and gas wells, and in particular to a selectively fired, pressure relief subassembly for a downhole chemical cutting tool.

BACKGROUND OF THE INVENTION

Downhole, chemical cutting tools, often called chemical cutters, have been used to sever, or cut into two separate sections, steel tubular members within oil and gas wells. Typically, a chemical cutter is used when a lower section of a steel pipe string, such as a tubing string, a casing string, or a drill string, is stuck within a well, and it is desired to sever the lower section of the pipe string to allow retrieval of an upper portion of the pipe string from the well. A chemical cutter may be lowered within the stuck pipe string on a wireline to a position adjacent to the portion of the pipe string which is to be severed. Then, a flammable solid is ignited within the chemical cutter to force a liquid cutting chemical to flow over a chemical activator, and then outward of the chemical cutter through flow ports. The flow ports are arrayed for directing the activated cutting chemical to discharge in a pattern which extends circumferentially around the chemical cutter and into an annular-shaped section of the pipe string surrounding the chemical cutter. The cutting chemical and the activator are selected to provide high temperatures and pressures, such that the cutting chemical will cut through the adjacent section of the steel pipe string, severing the section into two halves. Activation of the cutting chemical and downhole well pressures expose the interior of the chemical cutter to high pressures, which should be released from being contained within the chemical cutter prior to the cutter being removed from within a well.

Prior art chemical cutting tools have interior chambers connected by flow passages within which high pressures may become trapped, causing safety concerns if high pressure fluids are unexpectedly released on the surface after chemical cutters are retrieved from within wells. Pressure bleed-off ports have been provided which are manually operated at the surface after chemical cutters are retrieved from wells, such as by providing a threaded plug which blocks a bleed-off port when the tool is downhole, and which is manually removed from blocking the bleed-off port after a chemical cutter is removed from a well. Bleed-off ports are often of a small diameter, and may become sealed by debris from the well. Unexpected discharges of trapped pressures and chemical cutting fluid at the surface after retrieval from wells have caused injuries to persons and damage to equipment.

SUMMARY OF THE INVENTION

A chemical cutter is provided having a pressure relief feature, such that after the chemical cutter is operated for dispensing a cutting chemical in a well to severe a tubular member, the pressure within the chemical cutter is equalized with the pressure which is exterior of the chemical cutter. An interior passage extends through a central portion of a tool housing of the chemical cutter. A propellant disposed in the interior passage, and is ignited for creating pressure to push a cutting chemical from within the tool housing and into the well. A first ignitor passage extends parallel to a longitudinal axis of the tool housing, and in fluid communication with the interior passage. A first ignitor is disposed in the first ignitor passage, such that ignition of the first ignitor ignites the propellant. A second ignitor passage extends in the tool housing, and has a first portion which extends parallel to the longitudinal axis, spaced apart from the first ignitor passage. An interior opening is provided in an end of the first portion of the ignitor passage which is adjacent to the interior passage. The second ignitor passage also has a second portion which extends transverse to the longitudinal axis of the tool housing, from an exterior of the tool housing to the first portion of the second ignitor passage. An exterior opening is provided in the outward end of the second portion of the second ignitor passage. A second ignitor is disposed in the second ignitor passage.

A first seal member is disposed in the interior opening, sealing the second ignitor passage from the interior passage of the tool housing. A second seal member disposed in the exterior opening, sealing the second ignitor passage from the exterior of the tool housing. The first and second seal members seal the second ignitor from the interior passage and from the exterior of the tool housing after the first ignitor is ignited and the propellant is combusted to dispense the cutting chemical from the cutting tool. Igniting the second ignitor pushes the first seal member from the interior opening and the second seal member from the exterior opening, such that the second ignitor passage is in fluid communication with the interior passage and the exterior of the tool housing. A control circuit is provided having two diodes connected in parallel, a first diode is configured for passing current of a first polarity to the first ignitor and a second diode is configured for passing current of a second polarity to the second ignitor.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
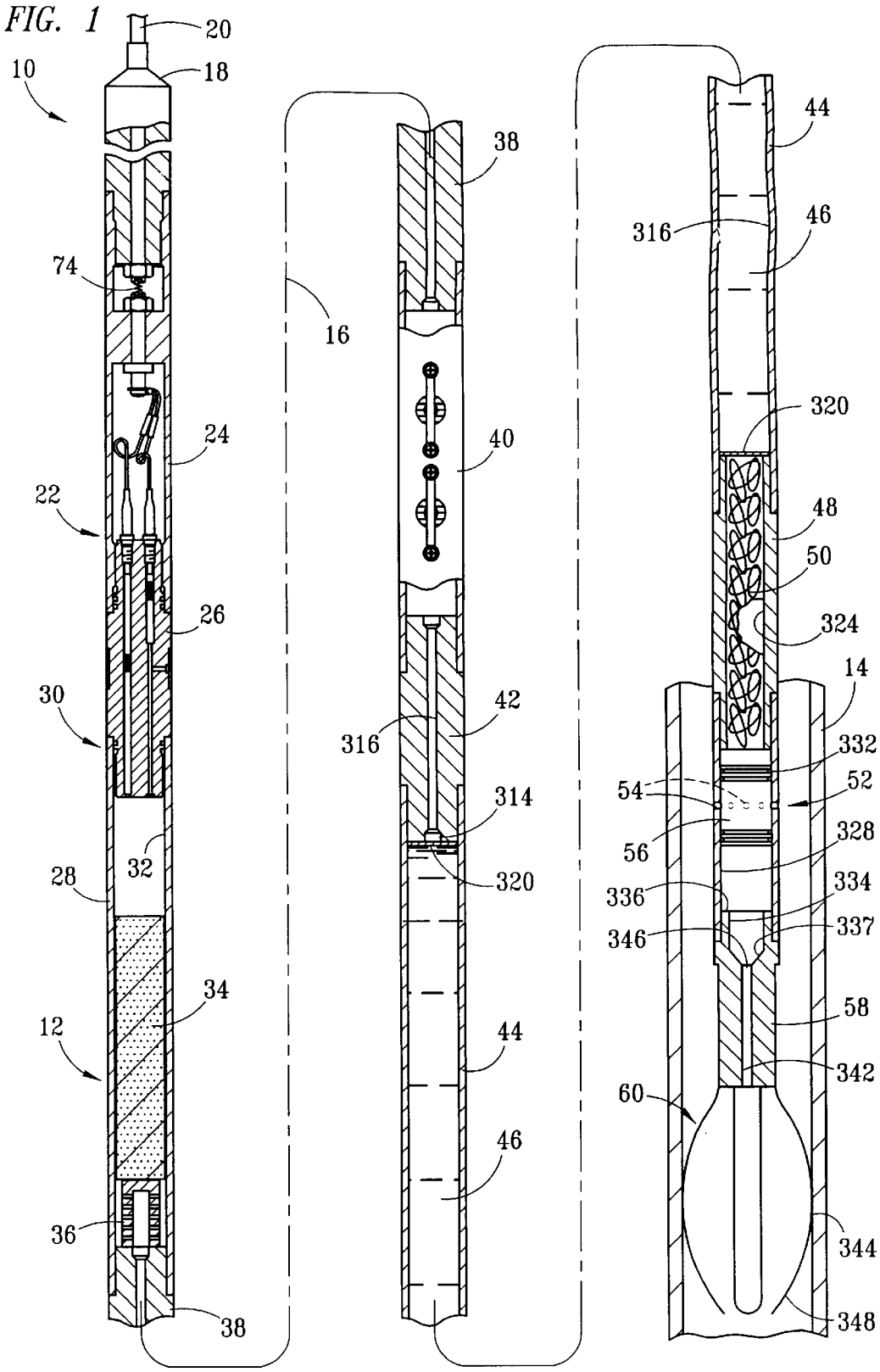
FIG. 1 is a partial, longitudinal section view of a downhole tool string having a chemical cutter which includes a selectively fired pressure relief subassembly.

FIG. 1 is a partial, longitudinal section view of a downhole tool string 10 having a chemical cutter 12 which includes a selectively fired, pressure relief and ignitor subassembly 22. The chemical cutter 12 is used in oil and gas wells for lowering into a tubular member 14, such as a portion of a drill string, tubing or casing, to sever the tubular member 14 into two sections. The tool string 10 and the chemical cutter 12 have a generally cylindrical shape with a centrally disposed, longitudinal axis 16. The tool string 10 includes a firing head 18, which is mounted to the end of a wireline 20. The chemical cutter 12 is preferably secured to the wireline 20 by the firing head 18, and is preferably lowered into a well on the wireline 20.

The subassembly 22 includes a control section 24 and an ignitor section 26, with a pressure relief feature. The control section 24 is threadingly secured to the firing head 18. An upper end of the ignitor section 26 is secured to the control section 24. A propellant section 28 is secured to the lower end of the ignitor section 26. The propellant section 28 has a centrally disposed pressure chamber 32 defined within the tool housing 30, coaxial with the longitudinal axis 16 of the tool string 10. A propellant 34, preferably ammonium perchlorate, is disposed within the pressure chamber 32. A strainer section 36 is disposed at the lower end of the pressure chamber 32 for trapping debris from ignition of the propellant 34. A pressure relief subassembly 38 is connected to the lower end of the strainer section 36, and connected to the upper end of an anchor section 40. A flow control section 42 is connected beneath the anchor section 40 and to the upper end of a chemical section 44. A cutting chemical 46 is disposed within the chemical section 44 when the chemical cutter 12 is ready for use. The cutting chemical 46 is preferably provided by bromine trifluoride (BrF3). The lower end of the chemical section 44 is connected to a combustion section 48 which houses a catalyst 50. The catalyst 50 is preferably provided by a steel wool, over which the cutting chemical 46 is passed to activate the cutting chemical 46. A cutting head 52 is connected to the lower end of the combustion section 48, and has flow ports 54. The flow ports 54 have central axes which extend radially outward relative to the longitudinal axis 16 in an angularly spaced apart pattern around the longitudinal axis 16 for dispensing the cutting chemical 46 in a desired phasing pattern for cutting the tubular member 14. A piston 56 is disposed in the cutting head 52 for sealing the flow ports 54 until the cutting tool 12 is fired. A bull plug 58 is mounted to the lower end of the cutting head 52, and has centralizer arms 60 for centering the cutting tool 12 within the tubular member 14.

Figure 2:
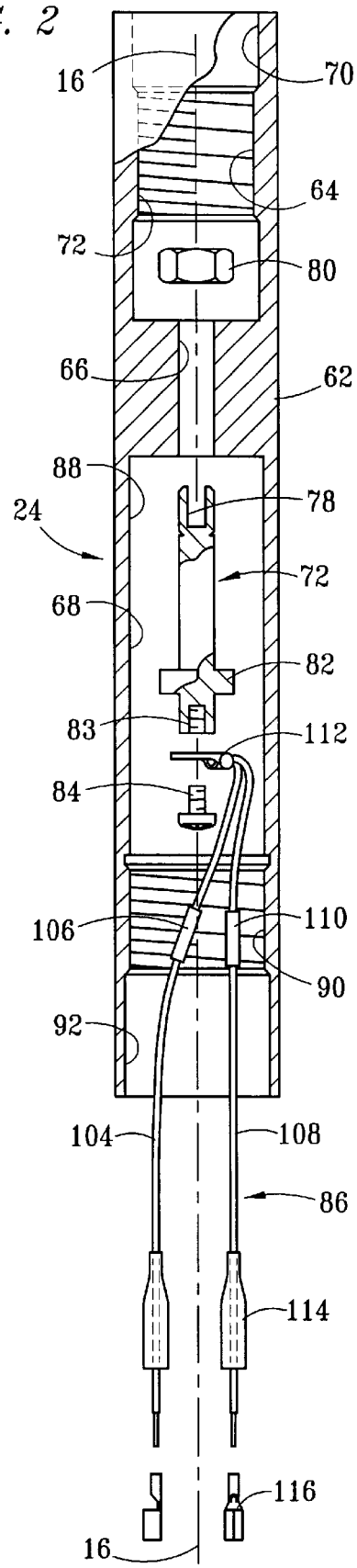
FIG. 2 is a longitudinal section view of a control section of the chemical cutter.

FIG. 2 is a longitudinal section view of the control section 24 of the chemical cutter 12, which includes an exploded view of a contact rod 76 and wiring harness 86. The control section 24 has a cylindrical housing 62 which has an open, upper chamber 64, an aperture 66 and a lower, open chamber 68, which are coaxially disposed with the longitudinal axis 16. The aperture 66 connects the upper chamber 64 to the lower chamber 68. The upper chamber 64 has an open upper end for receiving the lower end of the firing head 18, an upper portion which provides a seal surface 70, and an intermediate threaded portion 72 for securing to the threaded end of the firing head 18 (shown in FIG. 1). A lower portion of the chamber 64 receives the upward end of the contact rod 76.

The contact rod 76 is secured in the aperture 66, as shown in FIG. 1. The contact rod 76 has an insulating sleeve provided by a teflon tube, which insulates the contact rod 76 from making electrical contact with the housing 62. The upper, end face of the contact rod 76 has a socket 78 which preferably extends coaxial with the longitudinal axis 16, for receiving a contact spring 74 of the firing head 18 (shown in FIG. 1), to electrically connect the contact rod 76 to the firing head 18. The exterior of the upper end of the contact rod 76 is threaded for securing to a nut 80 for retaining the contact rod 76 in the aperture 66. The lower end portion of the contact rod 76 has an enlarged portion to define an annular-shaped shoulder 82 for retaining the contact rod 76 within the aperture 66. The lower end face of the contact rod 76 has a threaded hole 83 for receiving a threaded fastener 84 to secure the wiring a harness 86 to the contact rod 76, in electrical contact with the contact rod 76. An upper end of the lower chamber 68 defines a cavity 88 within which the wiring harness 86 extends, with ample room to prevent binding or crimping of the wiring harness 86 when the control section 24 is threadingly secured to the ignitor section 26 (shown in FIG. 1). A lower portion of the chamber 68 has a threaded portion 90 for securing to the ignitor section 26 (shown in FIG. 1), and a seal surface 92.

The wiring harness 86 includes a first conductor wire 104 having a first diode 106 and a second conductor wire 108 having a second diode 110. The conductors 104 and 108 are connected together at upper ends to a contact 112, which is secured in electrical contact with the contact rod 72 by the threaded fastener 84. The conductor wires 104 and 108 extend from the contact 112 to provide two parallel circuits, with the two diodes 106 and 110 configured in each circuit for passing current of opposite polarity, respectively. The diode 106 is connected for passing current from the contact rod 72 of positive polarity, and the diode 110 is configured for passing current from the contact rod 72 of negative polarity. Two contacts 116 are mounted to the terminal ends of the wires 104 and 108, respectively. Two rubber seal boots 114 are mounted on respective ones of the wires 104 and 108, for: sealingly securing to upper contacts 238 of sealed contact connectors 196 which are included in the ignitor section 26 (shown in FIG. 3). The two conductors 104 and 108 are of sufficient length such that the terminal ends thereof will extend outward of the housing 64 for connecting to the upper contacts of the ignitor section 26.

Figure 3:
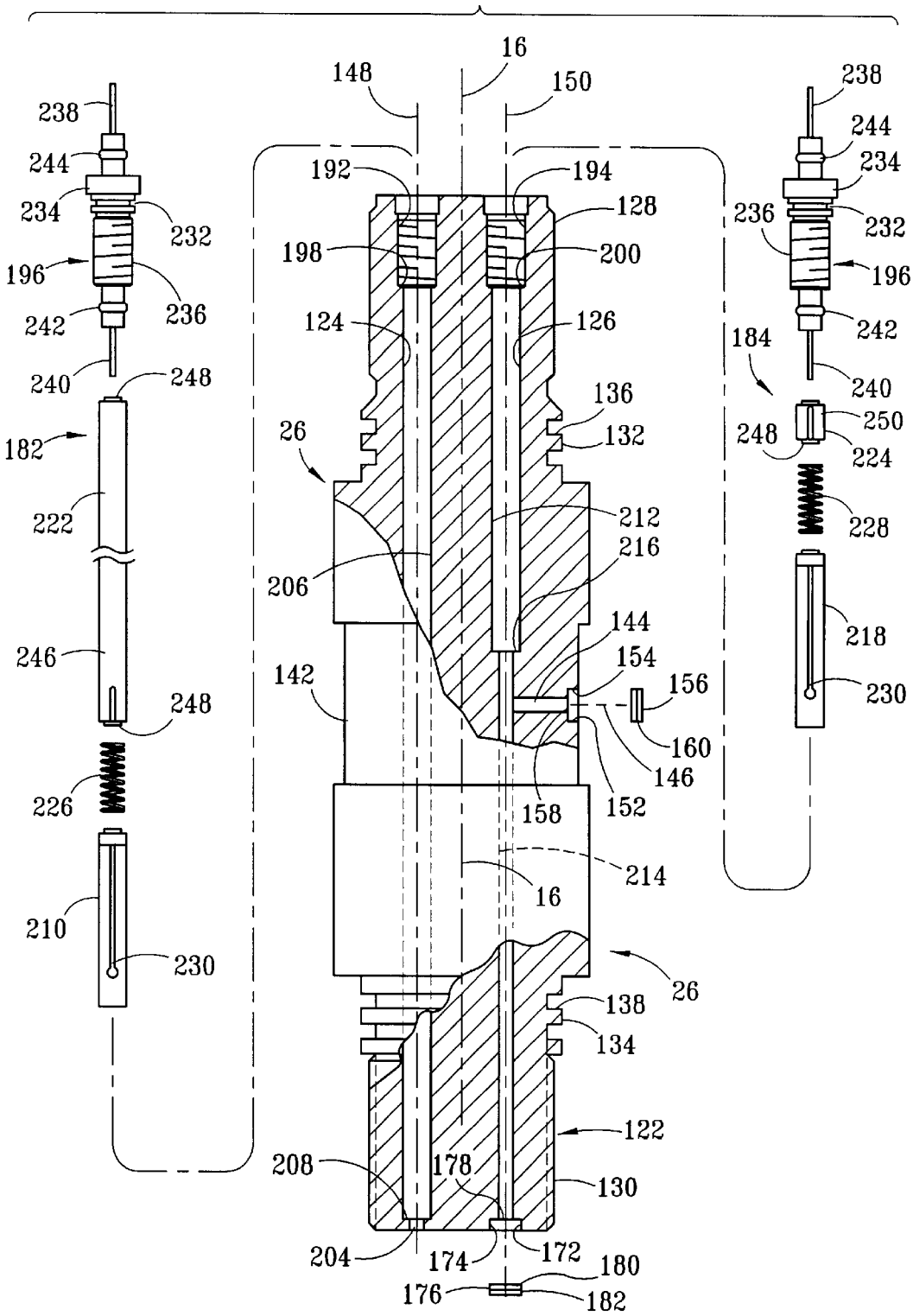
FIG. 3 is a longitudinal section view of an ignitor section of the chemical cutter.

FIG. 3 is a longitudinal section view of the ignitor section 26 of the chemical cutter 12, and includes an exploded view of the electric components of the ignitor section 26. The ignitor section 26 includes a housing 122 of generally cylindrical shape, having two flow passages 124 and 126 which are provided by bores that extend in parallel, longitudinally through the housing 122. The flow passage 124 provides a first ignitor flow passage. The exterior of the housing 122 has a threaded upper end 128 and a threaded lower end 130. Seal sections 132 and 134 are provided on respective ends 128 and 130, having seal glands 136 and 138, respectively. An annular shaped recess 142 is provided in an intermediate portion of the exterior of the housing 122. A port 144 is formed into the annular shaped recess 142, and extends from the exterior of the housing 122 directly into the flow passage 126 to connect the flow passage 126 to the exterior of the housing 122, at the annular shaped recess 142. The port 144 preferably, has a three-eighths inch diameter. The port 144 and the flow passage 126 together provide a second ignitor flow passage which extends from the interior passage defined by the pressure chamber 32, to the exterior of the tool housing 30 in the annular shaped recess 142. The port 144 preferably has a longitudinal axis 146 which is disposed transverse to the longitudinal axis 16. The two flow passages 124 and 126 preferably have longitudinal axes 148 and 150, respectively, which extend parallel to the longitudinal axis 16. The longitudinal axis 146 of the port 144 preferably extends perpendicular to the longitudinal axis 16 and the longitudinal axes 148 and 150.

The outward end of the port 144 has an enlarged portion 152, which preferably defines an exterior opening for the flow passage 126. A lower end of the flow passage 126 has an enlarged portion 172 which preferably defines an interior opening for the flow passage 126. The enlarged portion 152 which has a seal surface 154 for sealingly with a seal element 160 of a seal member 156, and has an annular-shaped shoulder 158 to provide a stop for engaging the seal member 156. The seal member 156 is preferably a round-shaped disk. The seal element 160 is preferably provided by an elastomeric O-ring which is disposed in a seal gland formed into the edge of the seal member 156. The lower end of the flow passage 126 has an enlarged portion 172 which has a seal surface 174 for engaging with a seal element 180 of a seal member 176, and has an annular shaped shoulder 178 which provides a stop for engaging the seal member 176. The seal member 176 is preferably a round-shaped disk. The seal element 180 is preferably provided by an elastomeric O-ring which is disposed in a seal gland formed into the edge of the seal member 176. The seal members 156 and 176 are preferably held in place within respective ones of the enlarged portions 152 and 172 of the port 144 and the flow passage 126 by friction of the seal elements 160 and 180 being squeezed between the respective ones of the seal members 156 and 176, and the seal surfaces 154 and 174. When lowered into a well, the seal member 156 is also held in place against the shoulder 158 by well pressures, until the second ignitor 218 is fired. Firing of the second ignitor 218 causes the pressure inside of the flow passage 126 to exceed the well pressure exterior of the tool 12, and the seal member 156 is pushed outward from sealing the interior opening defined by the enlarged portion of the flow passage 126. Firing of the second ignitor 218 also pushes the seal member outward from sealing the interior opening of the flow passage 126, which is defined by the enlarged portion 172.

Figure 4:
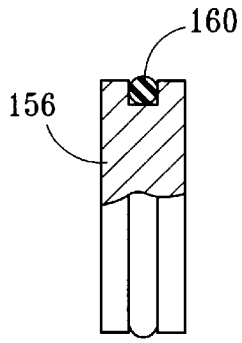
FIG. 4 is a side view of an upper seal member for use in the ignitor section to provide pressure relief for the chemical cutter.
Figure 5:
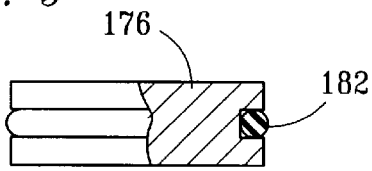
FIG. 5 is a side view of a lower seal member for use in the ignitor section to provide pressure relief for the chemical cutter.

FIG. 4 is a side view of the upper seal member 156 for use in the pressure relief subassembly 12 of the chemical cutter 12, and FIG. 5 is a side view of the lower seal member 176 for use in the pressure relief subassembly 26 of the chemical cutter 12. An O-ring disposed in a seal gland to provide the seal element 160. An O-ring is disposed in a seal gland to provide the seal element 160. Preferably, the seal member 176 has a thickness which is greater than the thickness of the upper seal member 156.

Referring again to FIG. 3, upper portions of the flow passages 124 and 126 have enlarged diameter portions defining sockets 192 and 194, respectively, for receiving the two sealed contact connectors 196. The lower ends of the sockets 192 and 194 define annular shaped shoulders 198 and 200, which define stops for the connectors 196. A lower end portion 204 of the flow passage 124 has a reduced diameter from the diameter of an adjacent intermediate portion 206 to define an annular shaped shoulder 208, which provides a stop for an ignitor 210. A lower intermediate section 214 of the flow passage 126 has a reduced diameter from the diameter of an upper intermediate section 212 of the flow passage 126 do define an annular shaped shoulder 216 which defines a stop for an ignitor 218. The diameter of the intermediate section 214 of the flow passage 126 is preferably three-eighths of an inch.

FIG. 3 also shows side elevation views of the electric contact components of the ignitor section 26, which include the two sealed contact connectors 196, a contact rod 222, a contact rod 224 and two spring contacts 226 and 228. A contact assembly 182 is an electrical conductor which is provided by the connector 196, the contact rod 222 and the contact spring 226, which electrically connects between the ignitor 210 and the wire 104. A contact assembly 184 is an electrical conductor which is provided by the connector 196, the contact rod 224 and the contact spring 228, which electrically connects between the ignitor 218 and the wire 108. The sealed contact connectors 196 are available from KEMLON PRODUCTS, of Pearland, Tex. Each of the sealed contact connectors 196 have two seal glands 232, preferably for receiving O-ring type seals. Shoulders 234 extend radially outward of the bodies 236 of the connectors 196. Upper contacts 238 and lower contacts 240 are insulated by ceramic enclosures, which include annular-shaped ceramic beads 242 and 244. The ceramic beads 242 align the contacts 240 within the flow passages 124 and 126, to prevent electrical contact between the housing 122 and the contacts 240. The annular-shaped ceramic beads 244 provide an enlarged portion for the seal boots 114 (shown in FIG. 2) to engage.

The contact rods 222 and 224 engage between respective ones of the contacts 240 and the contact springs 226 and 228. The outer diametrical surfaces of the rods 222 and 224 are insulated by outer non-conductive, plastic sleeves 246 and 250, respectively, to prevent direct electrical contact between the rods 222 and 224, and the housing 122. Rod end tips 248 are disposed on opposite, longitudinal ends of the contact rods 222 and 224. The rod end tips 248 have a smaller diameter than the outer diameter of intermediate portions of the rods 222 and 224, and are sized such that the end tips 248 will fit within the springs 226 and 228, centering the springs 226 and 228 with respect to the longitudinal azis 148 and 150 of the flow passages 124 and 126, respectively. The springs 226 and 228 and the end tips 248 are sized in relation to the interior diameters of the flow passages 124 and 126, such that the springs 226 and 228 will remain centered within the flow passages 124 and 127 and not make direct electrical contact with the sidewalls of the flow passages 124 and 126, and the housing 122. The contact springs 226 and 228 electrically engage the tops of the ignitors 210 and 218. Contact wires 230 are provided on the sides of each of the ignitors 210 and 218 for making contacting the sidewall of the flow passages 124 and 126, respective, to electrically connect to the housing 122 and complete the firing circuit for the ignitors 210 and 218.

Figure 6:
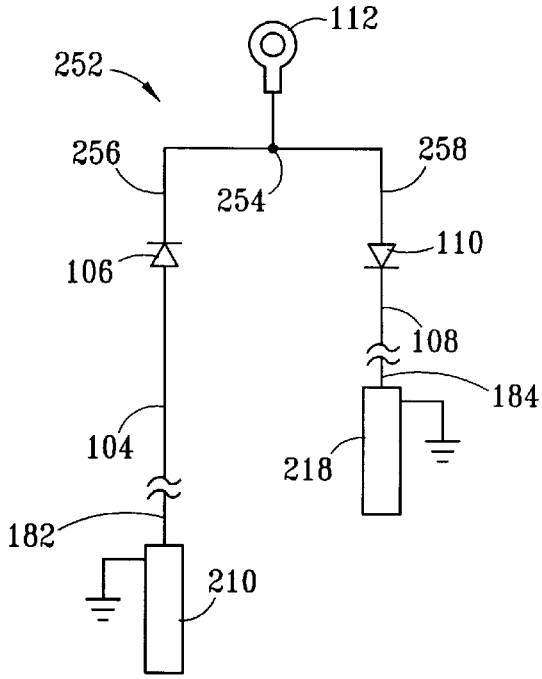
FIG. 6 is a is a schematic diagram of electrical components used in the control section of the chemical cutter.

FIG. 6 is a is a schematic diagram of an electrical control circuit 252 of the control section 14 of the chemical cutter 12. The control circuit 252 includes the contact 112 connected to a node 254, and two parallel circuits 256 and 258 connected to the node 254. The first circuit 256 includes the conductor 104, which has an upper end connected to the node 254 and the contact 112. The diode 106 is connected in series between two sections of the conductor 104, with the diode 106 aligned in a configuration for passing negative current through from the node 54 to the ignitor 210, and preventing positive current from passing in the same direction. The lower end of the conductor is connected to the contact assembly 182, which provides an electrical conductor which connects between the wire 104 and the upper end of the ignitor 210. The circuit 256 is completed by the contact wire 230 of the ignitor 210 contacting the conductive housing 122, which provides a ground for the circuit 256. The second circuit 258 includes the conductor 108, which has an upper end connected to the node 254 and the contact 112. The diode 110 is connected in series between two sections of the conductor 104, with the diode 110 aligned in a configuration for passing positive electric current from the node 54 to the ignitor 218, and preventing negative current from passing in the same direction. The lower end of the conductor 108 is connected to the contact assembly 184, which provides an electrical conductor which connects between the wire 108 and the upper end of the ignitor 218. The circuit 258 is completed by the contact wire 230 of the ignitor 218 contacting the conductive housing 122, which provides a ground for the circuit 258.

Figure 7:
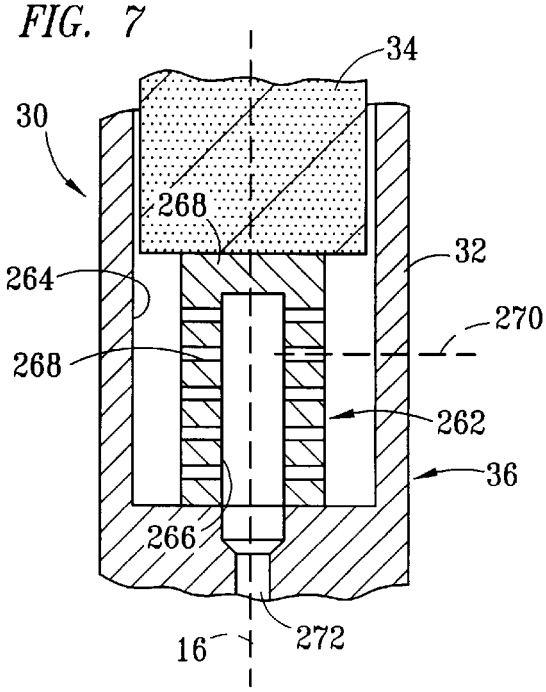
FIG. 7 is a partial, longitudinal section view of a strainer section of the chemical cutter.

FIG. 7 is a partial, longitudinal section view of a strainer section 36 located in the lower end of the pressure chamber 32. The strainer section 36 has a strainer body 262 which is centrally disposed within the lower end of the pressure chamber 32 to define an annular flow passage 264 which extends between the tool housing 30 and the outer diameter of the strainer body 262, preferably coaxial with the longitudinal axis 16. The annular flow passage 264 extends within the pressure chamber 32, exteriorly of the strainer body 262. A central strainer flow passage 266 is defined within the interior of the strainer body 262, and preferably extends coaxially with the longitudinal axis 16 and the annular flow passage 264. The upper end 268 of the strainer body 262 is solid to seal the uppermost end of the central strainer flow passage 266. The lower end of the central strainer flow passage 266 extends directly into a flow passage 272 of the pressure relief subassembly 38. Flow ports 268 are defined by a plurality of holes which preferably have central axes 270 that are perpendicular to the longitudinal axis 16, and which provide flow passages that extend between the annular flow passage 264 and the central flow passage 266.

When the propellant 34 is ignited, debris will become trapped in the annular flow passage 264 as high pressure gases provided by combustion of the propellant 34 pass from the pressure chamber 32, into the annular flow passage 264, and then will change from a first flow direction which is generally parallel to the longitudinal axis 16 within the annular flow passage 264 to a second flow direction which generally transverse to the longitudinal axis 16 in passing from the annular flow passage 264 and into the flow ports 268 in the sidewall of the strainer body 262. After passing through the flow ports 268, the high pressure gases will again change flow direction from the second flow direction which is generally transverse to the longitudinal axis 16 when passing through the flow ports 268, to a third flow direction which is generally parallel to the longitudinal axis 16 in the central flow passage 266. The high pressure gas then passes from the central flow passage 266 and into the flow passage 272 of the pressure relief subassembly 38.

Referring again to FIG. 1, the pressure relief subassembly 38 has the flow passage 272 which connects between the strainer 36 in the lower end of the propellant section 28 and the upper end of the anchor section 40. In the preferred embodiment, the flow passage 272 is sized to have approximately a diameter of three-eighths of an inch, which is of a size for restricting the flow of gases from the propellant section 28 into the anchor section 40. In other embodiments, a plate may be used having an orifice of a selected size to provide a desired flow rate of propellant gases from the propellant section 28 to the anchor section 40. A pressure bleed port 274 is connected to the flow passage 272 and extends transversely from the flow passage 272 to the exterior of the pressure relief subassembly 38. A seal member 276 is preferably provided by a threaded plug, which seals the pressure bleed port 274. Preferably, the seal member 276 has a seal element, such as an elastomeric O-ring. The seal member 276 is removed from sealing the pressure bleed port 274 after the tool 12 is removed from a well to bleed off pressure which may be trapped within the flow passage 272 after the cutting tool is run to sever a tubular member 14.

Figure 8:
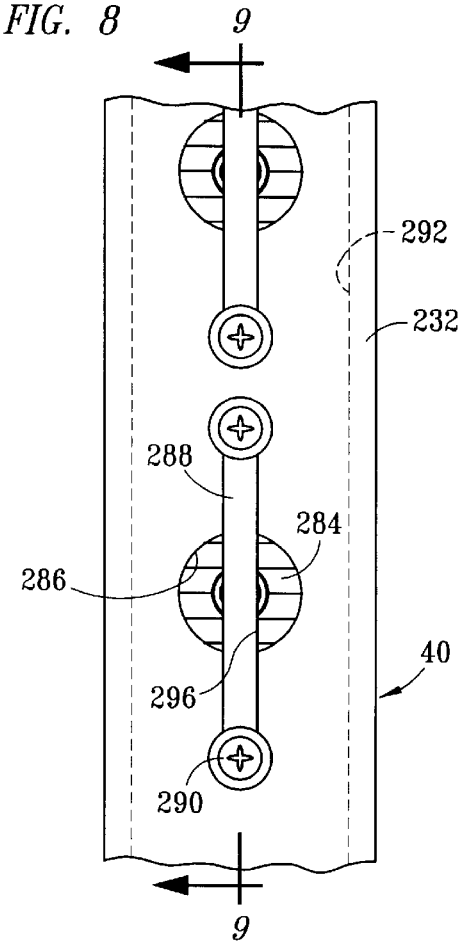
FIG. 8 is a partial, side view of an anchor section of the chemical cutter.
Figure 9:
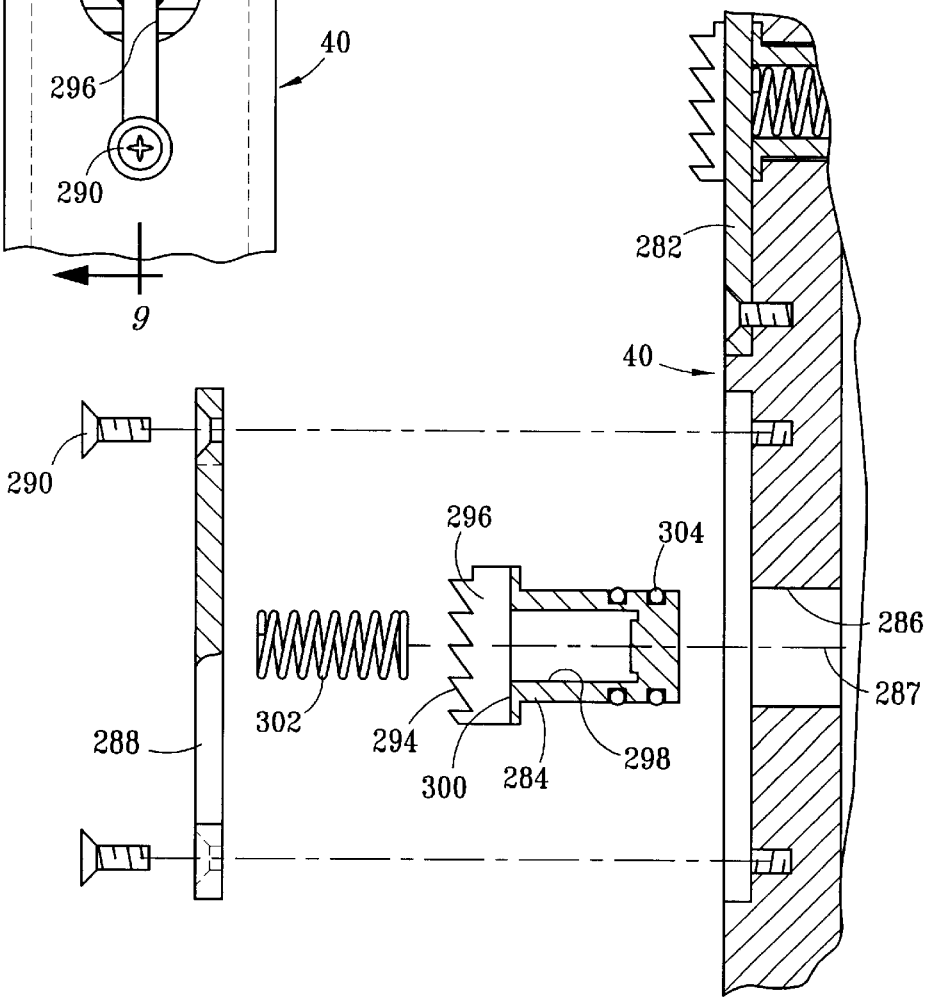
FIG. 9 is a partial cutaway and exploded view of the anchor section of the chemical cutter.

FIG. 8 is a partial, side elevation view and FIG. 9 is a partial cutaway, and exploded view of an anchor section 40 of the chemical cutter 12. The anchor section 40 has a housing 282 and slidably extendable anchor members 284, which are retained in holes 286 in the anchor section 40 housing 282 by retainer bars 288. The retainer bars 288 are fixedly secured to the housing 282 with threaded fasteners 290. There are six holes 286, with vertically adjacent pairs of the holes 286 being offset, or angularly spaced apart, one-hundred and twenty degrees around the longitudinal axis 16. The vertically adjacent pairs of holes each extend from respective ones of three central flow passages 292. The three flow passages 292 have preferably each have an internal diameter 0.187 inches, and extend longitudinally through the anchor section 40. The central flow passages 292 are preferably coaxial with the longitudinal axis 16, and the holes 286 have axes 287 which extend transverse, preferably perpendicular, to the longitudinal axis 16. The outward ends of the anchor members 284 have teeth 294 for grippingly engaging a tubular member 14 (shown in FIG. 1) being severed with the cutting tool 12, to secure the chemical cutter 12 in a fixed position within the tubular member 14. Slots 296 extend into the outward end of the anchor members 284 for receiving the retainer bar 288, for a depth which provides sufficient travel of the anchor members 284 to move outward from within the holes 286 for grippingly engaging the interior surface of the tubular member 14 being cut by the cutting tool 12. The slots 296 are formed into the outward end of the anchor members 284 to define shoulders 300 which engage the inwardly disposed sides of the retainer bars 288 when the anchor members are fully extended within a well, such that the shoulders 300 define stops which engage against the retainer bars 288 to retain the anchor members within the holes 286. Blind holes 298 are formed into the outward faces of respective ones of the anchor members 284 for receiving bias springs 302. The bias springs 302 urge the anchor members 284 into the holes 286, except when the biasing forces of the springs 302 are overcome by the high pressure of propellant gasses within the central flow passages 292 when the propellant 34 is ignited. After the propellant 34 is expended and the pressure is relieved within the central flow passages 292, the bias springs 302 will push the anchor members 284 back into respective ones of the holes 286 to release the cutting tool 12 from the tubular member 14 being severed so that the cutting tool 12 may be retrieved from the well. Seals 304 are provided on the inward ends of the anchor members 284, preferably by two O-rings for each of the anchor members 284.

Referring again to FIG. 1, a flow control section 42 has a central flow passage 312 which preferably extends parallel to the longitudinal axis 16. The flow passage 312 has an interior diameter which restricts flow through the flow control section 42 to an exit portion 314. In the preferred embodiment, the inside diameter of the flow passage 213 is one-quarter inch. In other embodiments, an orifice of a particular size may be used, such as a disk-shaped plate having an orifice hole for disposing in the exit portion 314, for controlling the rate at which gas provided by the propellant will pass from the anchor section 40, and through the flow passage 312 and into the chemical section 44.

A chemical section 44 has an interior chemical chamber 316, within which the chemical 46 providing the cutting fluid is disposed. Rupture discs 320 are provided on opposite ends of the chemical chamber 316 to contain the chemical cutting fluid 46 within the chemical chamber 316 until the propellant 34 is ignited. The rupture discs 320 are sized such that pressures within the cutting chemical tool 12 achieved by ignition of the propellant 34 will rupture both the upper and the lower discs 320, and the cutting fluid will be pushed downward and from within the chemical section 44 into the combustion section 48.

The combustion section 48 has a combustion chamber 324 defined in within the tool housing 122. The tool housing 122 is part of the housing 30 of the chemical cutter 12. The combustion chamber 324 defines a central passage within which is disposed a catalyst 50. The catalyst 50 is preferably provided by steel wool, which reacts with the cutting chemical 46 to activate the cutting fluid to reach high temperatures and pressures, to overcome well pressures and cause activated cutting fluid to pass through the flow ports 54 of the cutting head 52 at high velocity. The cutting chemical 46 will flow from within the combustion section 48 and into the cutting head 52.

The cutting head 52 has a central flow passage 328 and flow ports 54. Prior to igniting the propellant 34 to operate the tool, a piston 56 is disposed within the central flow passage 328 of the cutting head 52. Seals 332 are disposed on opposite ends of the piston 56, such that the piston will straddle the flow ports 54, with the seals 332 preventing flow through the flow ports 54. An upper piston latch 334 is provided for securing the piston in the sealing position (shown in FIG. 1) such that the central flow passage 328 is sealed to prevent fluid flow between the flow passage 328 and the flow ports 54. After the propellant 34 is ignited, the piston 56 will be moved downward within the flow passage 328, into a downward position located beneath the flow parts 54. The piston 56 will not move downward until the pressure of the cutting chemical fluid 46 exceeds the well pressures exterior of the tool, which are in communication with a central passage 342 of the bull nose 58 and the bottom of the piston 56. Once the well pressures exterior of the cutting tool 12 are overcome, the piston 56 will move downward within the cutting head 52, until a lower piston latch 336 secures the piston 56 in the downward position, to allow the activated cutting chemical 46 to pass through the flow ports 54 and from within the chemical cutter 12.

The flow ports 54 of the cutting head 52 are arranged in a phasing pattern, such that the cutting chemical 46, once activated, will preferably be evenly dispersed in a desired pattern to evenly sever the tubular member 14 being cut with the cutter 12. The flow ports 54 are preferably angularly spaced apart around the central axis 16, in an evenly spaced pattern along a circumference of the tool housing 30 of the chemical cutter 12. Central axes of the flow ports are preferably disposed at right angles to the longitudinal axis 16 of the chemical cutter 12, equally spaced around a circumference of the tool housing 30.

A bull plug 58 is provided on the lower end of the cutting tool 12. Centralizer arms 60 are mounted to extend downward from the bull plug 58 to provide a centralizer for centering the lower end of the cutting tool 21 within a tubular member 14 in a well. A central passage 342 is provided through the bull plug 58 to apply well fluid pressures to the lower end of the piston 56, so that the piston 56 will not move downward from sealing the flow ports 54 from communicating with the central flow passage 328 until after the pressure within the cutting head 52 exceeds the pressure of the well fluid exterior of the tool 12. This prevents flow of well fluids through the flow ports 54 and into the tool housing 30 prior to the cutting chemical 46 being activated to pressures which exceed well pressures. The lower end face of the tool housing 48 provides an annular-shaped stop to prevent well pressures acting on the lower end of the piston 56 from pushing the piston 56 upwards from sealing the flow ports 54. The lower end of the combustion section 48 provides an annular-shaped stop 336 for a lower position of the piston 56.

In operation, the chemical cutter 12 is lowered into a well and located relative to a tubular member 14 which is to be severed, such that the flow ports 54 of the cutting head 52 are aligned with a desired cutting plane. Then, current of negative polarity is applied to the chemical cutter 12, which is passed through the diode 106 and to the ignitor 210. Firing of the ignitor 210 ignites the propellant 34, which provide high pressure gasses. The gasses pass through the strainer 36, the subassembly 38 and into the anchor section 40. The pressure of the gasses pushes anchor members 284 outward from within the tool housing 30 against the force of the bias springs 302, and engages the teeth 294 of the anchor members 284 with the interior of the tubular member 14, to secure the cutting tool 12 in a fixed position within the well as the cutting chemical 46 is dispensed from within the tool housing 30. The pressure of the gasses will also rupture the plates 320, allowing the cutting chemical 46 to flow from within chemical chamber 316 of the chemical section 46, and through the catalyst 50 in the combustion section 48. The pressure of the gasses will also push the piston 56 downward, to allow the activated cutting chemical 46 to flow from within the combustion section 48, through the cutting head 52 and outward from the tool housing 30 through the flow ports 54. The activated cutting chemical will come into contact with the section of the tubular member 14 adjacent the flow ports 54, cutting through the tubular member 14.

The pressure within the chemical cutter 12 caused by ignition of the propellant 34 will then bleed off, and the bias springs 302 push the anchor members 284 back into the tool housing 30, releasing the teeth 294 of the anchor members 284 from gripping the tubular member 14. The tool may then be retrieved, to a location just beneath the surface of the well, or into a riser above the wellhead. Preferably, current of positive polarity is applied to the chemical cutter 12, which is passed through the diode 110 to the ignitor 218. Firing of the ignitor 218 pushes the seal members 156 and 176 from within the sockets 152 and 172, respectively. This creates a flow passage between the interior passage 32 and the exterior of the tool housing 30, so that pressure may be equalized prior to removing the chemical cutter 12 from the well. If necessary to equalize pressure between well and the interior of the anchor section 40 when the chemical cutter 12 is downhole, such as to release the teeth 294 of the anchor members 284 from gripping the tubular member 14, the ignitor 218 may be fired when the chemical cutter 12 is downhole.

The present invention provides various advantages over the prior art. A chemical cutter is provided which has a pressure relief feature for equalizing pressure between an interior passage and an exterior of the tool housing. A flow passage is selectively opened by selectively firing an ignitor, which removes two seal members from sealing the flow passage. The ignitor may be selectively fired downhole if necessary to release the tool from within a tubular member being cut by the chemical cutter, or the ignitor may be selectively fired close to the surface of the well to relieve pressures trapped within the interior of the chemical cutting tool.

Although the preferred embodiment has been described in detail, it should be understood that various changes, substitutions and alterations can be made therein without departing from the spirit and scope of the invention as defined by the appended claims.

What is claimed is:

1. A chemical cutter for dispensing a cutting chemical in a well to severe a tubular member, comprising:

a tool housing having an interior passage which extends through a central portion of said chemical cutter;

a propellant disposed in said interior passage, being ignitable for creating pressure to push said cutting chemical from within said tool housing and into said well;

a first ignitor passage in fluid communication with said interior passage;

a first ignitor disposed in said first ignitor passage, such that ignition of said first ignitor ignites said propellant disposed in said interior passage;

a second ignitor passage which is, at least in part, spaced apart from said first ignitor passage and which is in fluid communication with said interior passage, said second ignitor passage having an interior opening in fluid communication with said interior passage, and an exterior opening in fluid communication with an exterior of said tool housing;

a second ignitor disposed in said second ignitor passage;

a first seal member extending across and sealing said second ignitor passage, between said second ignitor and said interior passage of said tool housing;

a second seal member extending across and sealing said second ignitor passage, between said second ignitor and the exterior of said tool housing;

wherein said first and second seal members seal said second ignitor from said interior passage and the exterior of said tool housing after said first ignitor is ignited and the propellant is combusted to dispense the cutting chemical from said tool housing;

wherein igniting said second ignitor removes at least part of said first seal member from extending across and sealing said second ignitor passage, and removes at least a portion of said second seal member from extending across and sealing said second ignitor passage, such that said interior passage of said tool housing is in fluid communication with said second ignitor passage and the exterior of said tool housing.

2. The chemical cutter according to claim 1, further comprising a control circuit having two diodes connected in parallel, a first diode configured for passing current of a first polarity to said first ignitor and a second diode configured for passing current of a second polarity, opposite said first polarity, to said second ignitor.

3. The chemical cutter according to claim 1, further comprising, the first ignitor passage has an upper end in which is secured a first sealed contact connector and the first portion of the second ignitor passage has an upward end in which is secured a second sealed contact connector, wherein the first and second sealed contact connectors are electrically connected to a control circuit and to respective ones of the first and second ignitors.

4. The chemical cutter according to claim 1, wherein said first and second seal members are disc-shaped members which fit within said interior and exterior passages.

5. The chemical cutter according to claim 1, wherein said second ignitor passage has interior and exterior openings which are defined by sockets formed into the tool housing, said interior opening being defined formed in a first portion of said second ignitor passage which adjacent to said interior passage and said exterior opening being formed in a second portion of said second ignitor passage which is adjacent to the exterior of the tool housing.

6. The chemical cutter according to claim 5, wherein said first and second seal members are disc-shaped members which fit within said interior and exterior openings, and which are blown from within respective ones of the interior and exterior openings of said second ignitor passage in response to igniting of said second ignitor.

7. The chemical cutter according to claim 6, further comprising a control circuit having two diodes connected in parallel, a first diode configured for passing current of a first polarity to said first ignitor and a second diode configured for passing current of a second polarity, opposite said first polarity, to said second ignitor.

8. The chemical cutter according to claim 7, further comprising, the first ignitor passage has an upper end in which is secured a first sealed contact connector and the first portion of the second ignitor passage has an upward end in which is secured a second sealed contact connector, wherein the first and second sealed contact connectors are electrically connected to the control circuit and to respective ones of the first and second ignitors.

9. A chemical cutter for dispensing a cutting chemical in a well to severe a tubular member, comprising:

a tool housing having an interior passage which extends through a central portion of said chemical cutter, said tool housing having a longitudinal axis;

a propellant disposed in said interior passage, being ignitable for creating pressure to push said cutting chemical from within said tool housing and into said well;

a first ignitor passage extending in said tool housing, parallel to said longitudinal axis, and in fluid communication with said interior passage;

a first ignitor disposed in said first ignitor passage, such that ignition of said first ignitor ignites said propellant disposed in said interior passage;

a second ignitor passage extending in said tool housing, having a first portion which extends parallel to said longitudinal axis and spaced apart from said first ignitor passage, and having an interior opening in fluid communication with said interior passage;

said second ignitor passage having a second portion which extends transverse to said longitudinal axis of said tool housing, from an exterior of said tool housing to said first portion of said second ignitor passage, wherein said second portion has an exterior opening in fluid communication with the exterior of said tool housing;

a second ignitor disposed in said second ignitor passage;

a first seal member disposed in said interior opening, extending across and sealing said second ignitor passage, between said second ignitor and said interior passage of said tool housing;

a second seal member disposed in said exterior opening, extending across and sealing said second ignitor passage, between said second ignitor and the exterior of said tool housing;

wherein said first and second seal members seal said second ignitor from said interior passage and the exterior of said tool housing after said first ignitor is ignited and the propellant is combusted to dispense the cutting chemical from said tool housing; and wherein igniting said second ignitor removes at least part of said first seal member from said interior opening, and removes at least a portion of said second seal member from said exterior opening, such that said second ignitor passage is in fluid communication with said interior passage of said tool housing the exterior of said tool housing.

10. The chemical cutter according to claim 9, further comprising a control circuit having two diodes connected in parallel, a first diode configured for passing current of a first polarity to said first ignitor and a second diode configured for passing current of a second polarity, opposite said first polarity, to said second ignitor.

11. The chemical cutter according to claim 9, further comprising, the first ignitor passage has an upper end in which is secured a first sealed contact connector and the first portion of the second ignitor passage has an upward end in which is secured a second sealed contact connector, wherein the first and second sealed contact connectors are electrically connected to a control circuit and to respective ones of the first and second ignitors.

12. The chemical cutter according to claim 9, wherein said first and second seal members are disc-shaped members which fit within said interior and exterior passages.

13. The chemical cutter according to claim 9, wherein said interior and exterior openings are sockets which are formed into the tool housing, said interior opening being defined by a lowermost end of said first portion of said second ignitor passage and said exterior opening being defined by an outermost end of said second portion of said second ignitor passage.

14. The chemical cutter according to claim 13, wherein said first and second seal members are disc-shaped members which fit within said interior and exterior passages, and which are blown from within respective ones of the interior and exterior openings of said second ignitor passage in response to igniting of said second ignitor.

15. The chemical cutter according to claim 14, further comprising a control circuit having two diodes connected in parallel, a first diode configured for passing current of a first polarity to said first ignitor and a second diode configured for passing current of a second polarity, opposite said first polarity, to said second ignitor.

16. The chemical cutter according to claim 15, further comprising, the first ignitor passage has an upper end in which is secured a first sealed contact connector and the first portion of the second ignitor passage has an upward end in which is secured a second sealed contact connector, wherein the first and second sealed contact connectors are electrically connected to the control circuit and to respective ones of the first and second ignitors.

17. A method for operating a chemical cutter to equalize pressures in an interior passage of a tool housing of the chemical cutter with pressures exterior of the tool housing after running the chemical cutter in a well and operating to severe a tubular member, the method comprising the steps of:

providing the tool housing with first and second ignitor passages which are, at least in part, spaced apart and which are in fluid communication with an interior passage of the tool housing of the chemical cutter, wherein the second ignitor passage is in fluid communication with the interior passage and an exterior of the tool housing;

disposing a first ignitor in the first ignitor passage, in fluid communication with the interior passage of the chemical cutter;

disposing a second ignitor in a second ignitor passage;

removably disposing first and second seal members in the tool housing, with the first seal member sealing between the second ignitor and the interior passage of the tool housing and the second seal member sealing between the second ignitor and the exterior of the tool housing;

selectively applying electric current to a first one of two outputs of a control circuit to ignite the first ignitor and combust a propellant to dispense a cutting chemical from the chemical cutter into the well; and then, selectively applying electric current to a second one of the two outputs of the control circuit to ignite the second ignitor, which removes at least part of the first seal member and at least a portion of the second seal member from sealing between the interior passage and the exterior of the tool housing.

18. The method according to claim 17, wherein the step of selectively applying electric current to the second one of the two outputs of the control circuit to ignite the second ignitor removes the portion of the second seal member from an exterior opening of the second ignitor passage by pressures resulting from igniting the second ignitor blowing the second seal member out of the exterior opening and into the well.

19. The method according to claim 18, wherein the step of selectively applying electric current to the second one of the two outputs of the control circuit to ignite the second ignitor removes the at least part of the first seal member from an the interior opening of the second ignitor passage by the pressures resulting from igniting the second ignitor blowing the first seal member out of the interior opening and into the interior passage of the tool housing.

20. The method according to claim 19, wherein the step of providing a tool housing having first and second ignitor passages comprises:

forming a first bore through an ignitor section of the tool housing to define the first ignitor passage, extending parallel to a longitudinal axis of the tool housing;

forming a second bore through the ignitor section of the tool housing to define the second ignitor passage, extending parallel to the longitudinal axis of the tool housing and the first bore;

forming a first socket in a lower end of the second bore to define an interior opening;

forming a flow port from an exterior of the tool housing into the second bore, said flow port extending transverse to the longitudinal axis of the tool housing;

forming a second socket in an outer end of the flow port to define an exterior opening of the second ignitor passage; and wherein the first and second seal members are plugs which fit into the first and second sockets, and which are blown out of the sockets when the second ignitor is fired.

* * * * *